US006073269A

United States Patent [19]

Diaco

[11] Patent Number: 6,073,269

[45] Date of Patent: Jun. 13, 2000

[54] GOLF CLUB GRIP AIDING DEVICE

[76] Inventor: Benedict Diaco, 1100 SE. 5th Ct., #66, Pompano Beach, Fla. 33060

[21] Appl. No.: 08/757,481

[22] Filed: Nov. 27, 1996

[51] Int. Cl.[7] ..... A41D 19/00

[52] U.S. Cl. ..... 2/160; 2/161.2

[58] Field of Search ..... 2/16, 159, 160, 2/161.1, 161.2, 161.3, 161.4, 161.5, 163, 162, 907, 910, 917; 473/205

[56] References Cited

U.S. PATENT DOCUMENTS

| | | | |
|---|---|---|---|
| 2,083,604 | 6/1937 | Hay | 2/159 |
| 3,105,972 | 10/1963 | Christopher | 2/16 |
| 3,408,657 | 11/1968 | Gallager | 2/159 |
| 3,559,212 | 2/1971 | Skovron | 2/161.4 |
| 4,643,428 | 2/1987 | Churchill | 473/205 |
| 5,033,120 | 7/1991 | Myers | 2/161.4 |
| 5,088,122 | 2/1992 | O'Toole | 2/161.4 |
| 5,414,868 | 5/1995 | Crawford | 2/160 |
| 5,557,805 | 9/1996 | Emerson | 2/161.4 |

FOREIGN PATENT DOCUMENTS

| | | | |
|---|---|---|---|
| 406079029 | 3/1994 | Japan | 2/161.2 |

*Primary Examiner*—Danny Worrell
*Attorney, Agent, or Firm*—Malin, Haley & DiMaggio, P.A.

[57] ABSTRACT

A golf club aiding device comprising an elastic strap, hook-and-loop strap fasteners permanently attached to opposite ends of the elastic strap and hook-and-loop fasteners attachable to the outer surface of a golf glove over the three outside knuckles and the thumb knuckle, respectively, wherein the elastic strap is removably attachable to the glove by connecting the strap fasteners to the corresponding glove fasteners so that the three outside fingers on the upper hand are secured firmly around the golf club. The instant invention may also include a golf glove having the glove fastener permanently attached thereto.

5 Claims, 4 Drawing Sheets

GOLF CLUB GRIP AIDING DEVICE

BACKGROUND OF THE INVENTION

1. Field of the Invention

The instant invention relates generally to golf gloves, and more particularly, to golf gloves having a removable strap that enhances the firmness with which a golfer grips a golf club, while swinging the golf club.

2. Description of the Prior Art

Golfers constantly search for ways to improve their games. One aspect golfers focus on is the grip. Many golfers find it difficult to maintain a firm grip on the golf club throughout the swing and without unnecessary muscle tension. Golfers also prefer to concentrate on the swing rather than worrying about the grip. Establishing the proper grip is a especially problematic for inexperienced golfers and older persons with arthritis or similar ailments, and when the club gets wet. When a golfer fails to maintain a properly firm grip, alignment or orientation of the club face changes causing an undesirable spin to be imparted on the ball. An desirable spin can cause the ball to "uncontrollably slice" or "hook." On the other hand, if the club is held too tightly, the arm muscles experience too much tension, creating too rigid a swing and inaccurate contact with the ball. Although a proper grip is important for making clean contact with the ball, devoting too much concentration on the grip often jeopardizes the golfer's swing.

Golf gloves are normally worn to prevent the club from slipping and to obtain a comfortable grip. Golf gloves, however, are not capable of singularly enhancing a players grip, as seen in FIG. 1. There is a tendency during the swing, especially at the top of the backswing where the wrist breaks, for the upper hand fingers to loosen or separate from the shaft. This invariably results in rotation of the club and undesirable contact with the ball. As noted, holding a club too tightly can also result in poor contact. The ability to control the firmness and consistency of the grip, can help a golfer drastically reduce slices and hooks and hence improve their score.

A younger golfer may have the strength to retain a firm grip, but they often lack the requisite discipline. On the other hand, older or arthritic persons may have the discipline, but lack the strength. Thus, there exist a need for a gripping aid to help the golfer firmly hold the club during the swing without much thought so that the golfer can concentrate on the particulars of their swing.

There have been many attempts in the background art to provide a golf glove that assist the golfer in its grip. The gloves known provide straps for wrapping around the golfers hand, but either interfere with the golfer, or are ineffective for practical use because of their size, the way they attach to the glove and the orientation on the glove. For instance, some of the straps employed are permanently attached to the glove and cannot be removed when the golfer is putting or attempting a shot that does not necessitate the same firm grip. Other gloves have straps that are either too large or bunch up when the glove is gripped, making it difficult to comfortably hold and feel the club. There are still other gloves which use cumbersome fasteners, fail to remain securely affixed to the glove during use, or neglect to address the other concerns noted herein. Examples of the gloves employing various straps as noted above may be found in U.S. Pat. Nos. 5,553,324; 5,462,280; 5,423,089; 5,033,120; 4,665,565; 3,740,766; 3,559,212; 3,411,159; 3,408,657; 3,348,238; 3,105,972 and 2,852,779.

The above noted background art neither solves nor addresses problems contemplated by the present invention.

There remains a need for a golf club grip aiding device for assisting the golfer in firmly and comfortably gripping the club when needed so that the golfer may concentrate on swinging the club and making proper contact with the ball. The present invention solves these problems by providing a golf club grip aiding device that is removably attachable to a golf club and stretches around the golfers hand to assist the golfer in maintaining a firm grip. While the instant invention is described in detail below with respect to golf clubs, this invention works well for any glove in need of enhanced gripping characteristics.

SUMMARY OF THE INVENTION

In accordance with the foregoing, it is an object of the present invention to provide a golf club grip aiding device that may be conveniently and comfortably used in conjunction with a conventional golf glove to facilitate a firm grip.

Is also an object of the present invention to provide a golf grip aiding device that prevents a golfer's fingers from losing their grip or separating away from the club.

It is another object of the instant invention to provide a grip aiding device that remains securely attached to the glove during the swing without loosening or changing the golfer's backswing.

It is an additional object of the instant invention to provide a golf grip aiding device and system that is useable with any conventional golf glove.

It is a further object of the instance invention to provide a golf grip aiding device that is conveniently and quickly removable and reusable when changing clubs.

It is yet another object of the instant invention to provide a golf grip aiding device that is completely removable from the glove when the golfer is attempting touch oriented shots, such as putting and chipping.

It is yet an additional object of the instant invention to provide a grip aiding device that is stretchable and useable on all sized hands and on both left and right hands.

It is yet a further object of the instance invention to provide a grip aiding device that does not interfere with the interlocking or overlapping engagement of the fingers or with the player's conventional grip.

It is still another object of the instance invention to provide a strap that wraps around a golfers hand without bunching up or interfering with a golfer's normal grip.

In light of these and other objects, the grip enhancing device of the instant invention provides a golf club accessory kit comprising an elastic strap, a set of strap fasteners permanently affixed to the elastic strip at opposing ends, a set of glove fasteners attached to the outside of the glove at predetermined locations corresponding to the first set of fasteners, and a means for attaching the glove fasteners to the outside of the glove. The instant invention may also include a glove having the glove fasteners attached to the glove. The elastic strap/band comprises any conventional elastic textile material known in the art and defines a tapered end and an anchoring end. The elastic strap is preferably tapered from a predetermined mid-point on the band towards one end. The tapered end of the elastic band is important and critical for comfortably fitting on the hand. The other half of the elastic band preferably maintains a rectangular shape from the mid-point to the opposing anchor end of the band. Consequently, the tapered end of the elastic band has a narrower width than the anchoring end.

The strap fasteners of the instant invention preferably comprise a hook-and-loop VELCRO® permanently affixed to the opposing ends of the elastic band. The hook-and-loop strips are attached to the same side of the band at each end, i.e. the fastening end. The glove fasteners provide corresponding hook-and-loop fasteners which are attached to the outside surface of the golf glove. One glove fastener is securely affixed to the glove over the pinky finger, ring finger and middle finger knuckles. A second glove fastener is attached to the glove just over and behind the thumb knuckle next to the glove's wrist fastener. The glove fasteners are selected to correspond to the strap fasteners. The glove fasteners preferably comprise the loop or the soft component of the hook-and-loop fastening system for the user's comfort. Consequently, the strap fasteners comprise the hook or rough component of the hook-and-loop fastening system so as to correspond with the glove fasteners. The choice between hook-and-loop for attachment to the glove and elastic band may be changed without departing from the scope and spirit of the instant invention so long as the strap fasteners correspond to the glove fasteners for securely attaching the elastic band to the glove. In an alternative embodiment, the strap fasteners may employ a hook strip at one end and a loop strip at the opposite end, while the glove fasteners employ corresponding loop-and-hook strips so that the elastic band is limited to one orientation on the glove.

In the preferred embodiment of the instant invention, the glove fasteners are preferably adhered to the outside of the glove with a permanent adhesive, such as a contact adhesive. When using a contact adhesive, each strip of the second set of fasteners is oriented in their respected positions so that the user can determine and mark the area in which the fasteners will be placed. The contact adhesive is then applied to the marked areas on the glove to be coated and on each glove fastening strip. Once the adhesive gets tacky, the glove fasteners are firmly pressed to their respective areas on the glove.

It should be noted that the instant invention preferably comprises an accessory kit, including the elastic band, the strap fasteners and the glove fasteners. This allows the kit to be manufactured and used separately with any conventional glove. Alternatively, the instant invention may comprise of combination of the grip aiding accessory kit and the golf glove. In the alternative embodiment, the glove fasteners are preferably permanently stitched to the golf glove during manufacturing. The glove fasteners may also be attached with an adhesive.

The purpose of the instant invention is to assist golfers in firmly holding the golf club without having to concentrate on the grip. This allows the golfer to focus on the swing. The grip enhancing device of the instant invention prevents golfers from loosing their grip on the club, with respect to the last three fingers, while swinging. The anchoring end of the elastic strap is securely affixed to the strap fasteners above the last three fingers of the glove while the tapered end is pulled over the pinky, ring and middle fingers and around the base of the thumb for attachment to the fastener oriented over the thumb knuckle. As the tapered end wraps around the hand below the thumb, it has a narrowed width to prevent the strap from bunching up and affecting the golfer's grip. Another benefit of the instant invention is that the grip aiding device can be quickly removed by the golfer for "touch shots," such as chipping and putting, or anytime when the grip aiding device is not needed. In the preferred embodiment, the glove fasteners comprise the loop portion of VELCRO® so as to not interfere with the golfer's feel and comfort. This invention also facilitates the firm gripping of the club when the player's hand gets slippery from moisture, such as sweat or rain. The instant invention is especially useful for golfers that have arthritic conditions and other hand conditions which effect the ability to firmly hold on to a golf club when swinging. The grip aiding device allows these golfers to achieve a firm grip with comfort, thus allowing them to execute an effective swing while enjoying the game of golf.

In accordance with these and other objects which will become apparent hereinafter, the instant invention will now be described with particular reference to the accompanying drawings.

DETAIL DESCRIPTION OF THE PREFERRED EMBODIMENTS

Figure 1:
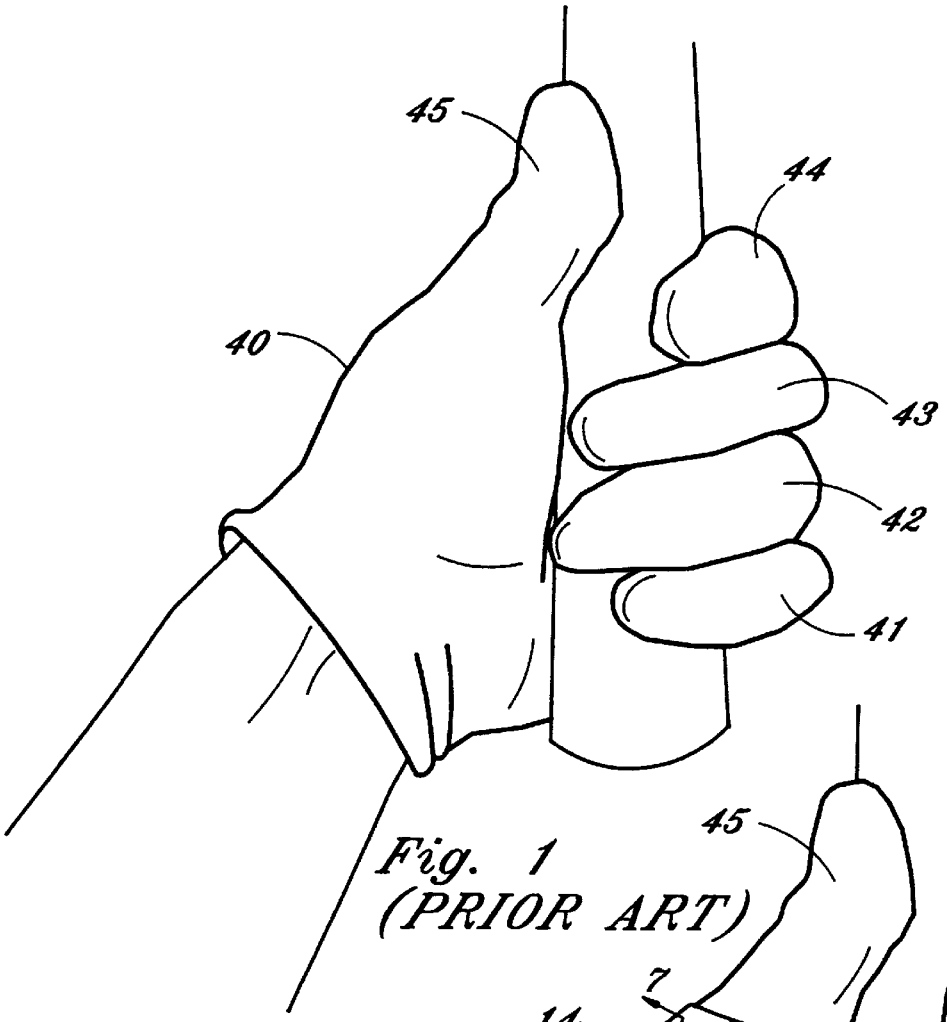
Fig. 1 (PRIOR ART)
FIG. 1 is a perspective view of a prior art golf glove.
Figure 2:
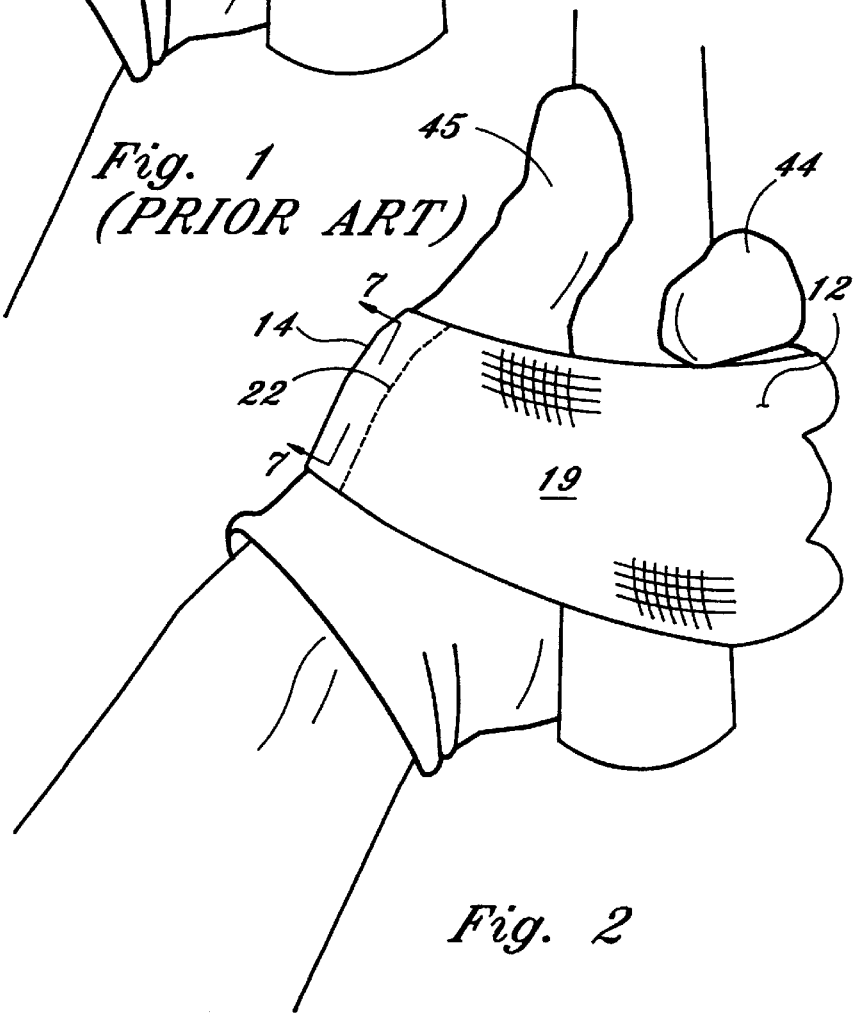
FIG. 2 is a palm side perspective view of the preferred embodiment of the golf club grip aiding device of the instant invention as used and worn by a golfer.
Figure 8:
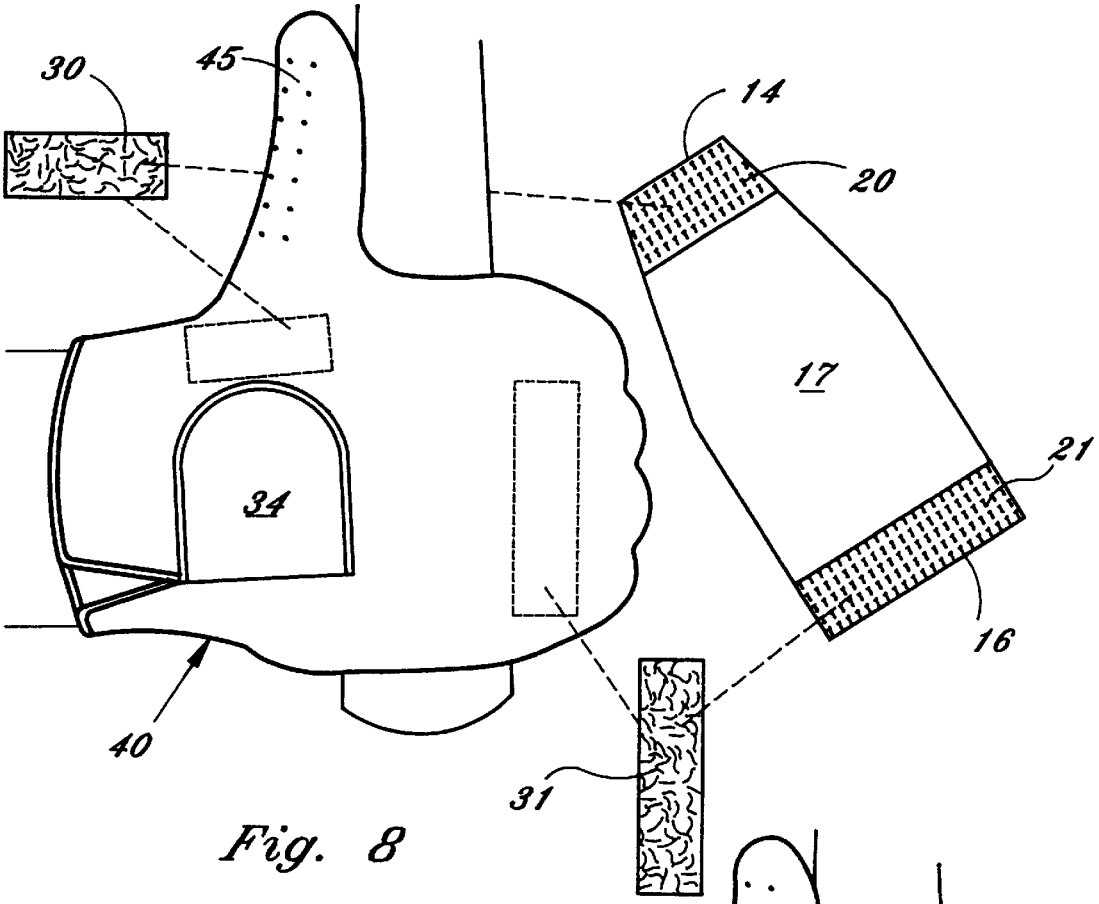
FIG. 8 is an exploded view of the instant invention.
Figure 3:
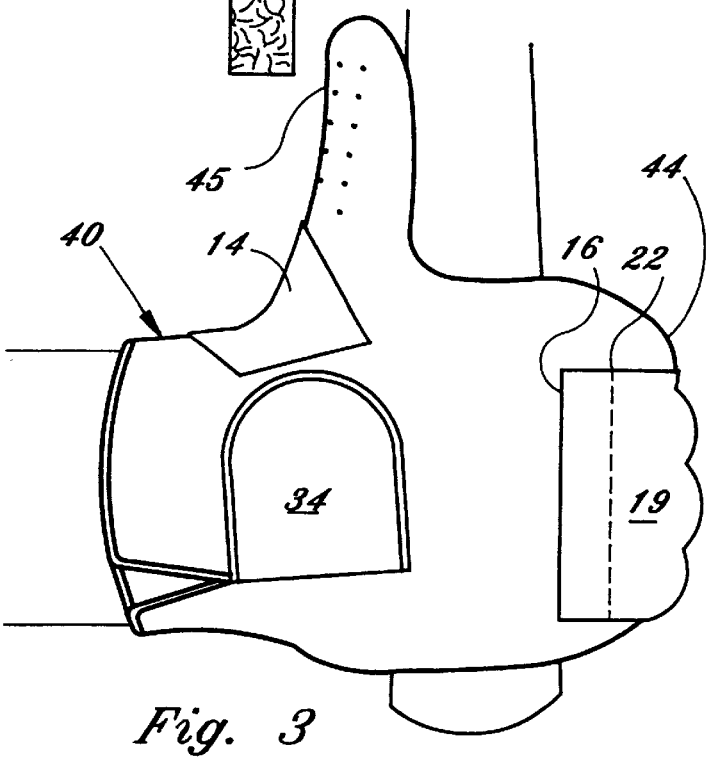
FIG. 3 is a back hand perspective view of the preferred embodiment of the grip aiding device as used and worn by a golfer.

With reference to the drawings, FIG. 2–9 depict the preferred embodiments of the grip aiding device of the instant invention which is generally referenced by the numerical 10. Referring to FIGS. 2 and 3, the grip aiding device 10 of the instant invention provides an accessory kit which may be manufactured or packaged with a conventional golf glove. As many golfers find it difficult to maintain a consistently firm grip throughout a swing, the grip aiding device or kit 10 of the instant invention assist the golfer in firmly holding the golf club without reorienting the club face. The instant invention allows the golfer to concentrate on properly swinging the club without having to worry about the firmness or correctness of the grip.

The grip aiding device 10 preferably comprises an elastic strap or band 12, strap fasteners 20, 21 for removably attaching the elastic strap 12 to the golf glove 40 and glove fasteners 30, 31 attachable to the glove 44 in mating connection with the strap fasteners 20, 21. With reference to FIGS. 2 and 3, the elastic 12 strap comprises a stretchable fabric, as is known in the art, that is removably attachable to the golf glove 40. The elastic strap 12 has a predetermined length, width and shape that is made to accommodate all sized hands. The elastic strap 12 is also symmetrical about its longitudinal access so that it is useable on both the left and right hands.

Figure 4:
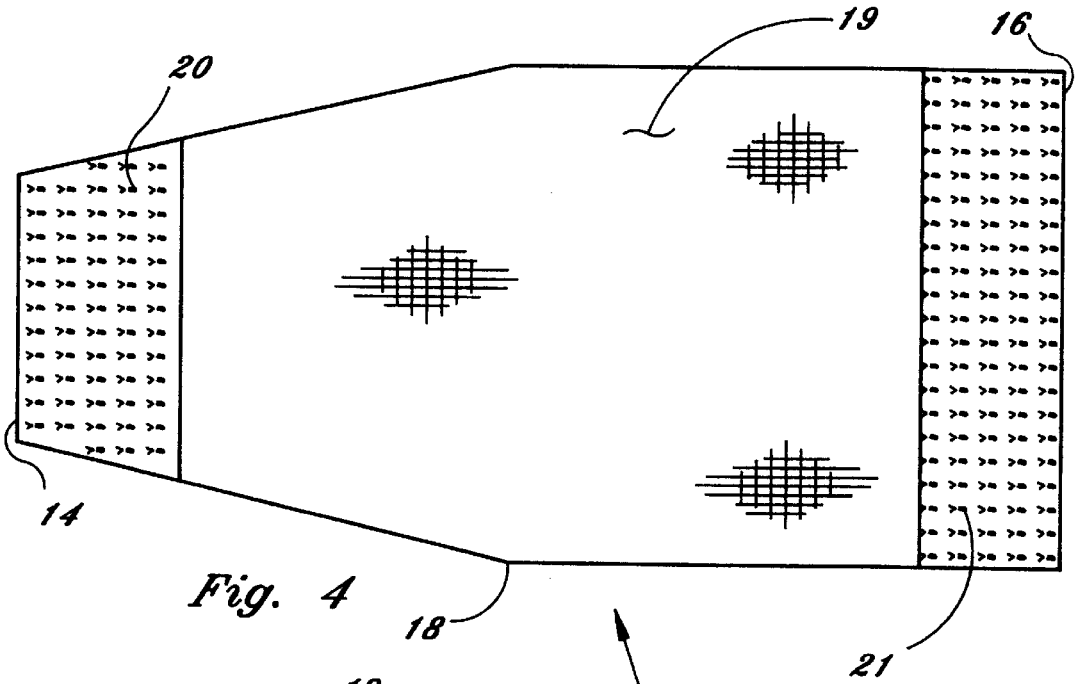
FIG. 4 is an elevational bottom view of the preferred elastic strap of the instant invention, illustrating the fastening surface and strap fasteners.
Figure 7:
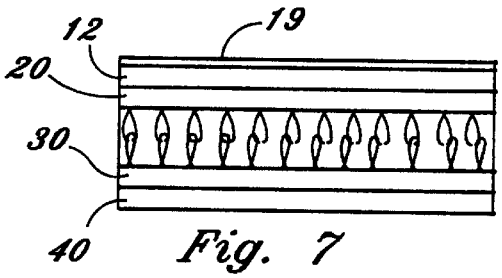
FIG. 7 is a cross sectional view of the connection between the strap and glove fasteners taken along lines 7—7 of FIG. 2.

Referring to FIG. 4, the elastic strap 12 has a tapered end 14 and a wider anchor end 16. The anchor end 16 is designed to mount to the glove 40 just above and across the knuckles of the three outside fingers, i.e. the pinky 41, ring 42 and middle fingers 43, as seen in FIG. 3. The tapered end 14 is designed to stretch around the hand near the base of the thumb 45 and attach to the glove just above the thumb knuckle, as seen in FIG. 3. The anchoring end 16 defines a larger width than the tapered end 14 so that it stretches across the three outside fingers 41–43 and securely anchors the strap 10 to the glove 40 when it is stretched and during use. It has been determined that the three outside fingers 41–43 should be covered and secured by the strap 12 since these fingers are critical in achieving a proper grip. Likewise, the pointer finger 44 and thumb 45 should be free. In an alternate embodiment, however, the elastic strap 12 may be more narrow in width to only cover the pinky and ring fingers.

Figure 5:
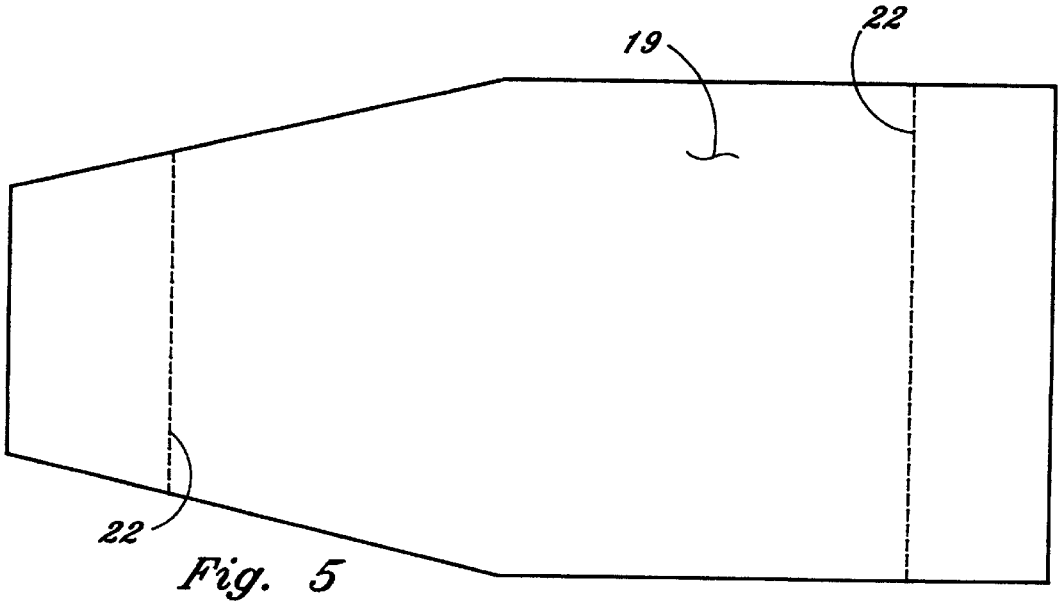
FIG. 5 is an elevational top view of the elastic strap of FIG. 4, illustrating the finished exterior surface and strap fastener stitching.

With reference to FIGS. 4 and 5, the elastic strap 12 preferably tapers from a pre-determined mid-point 18 on the strap 12 toward the tapered end 14. The distance between each end 14, 16 and the mid-point 18 is substantially the same, but may vary so long as the strap 12 between the mid-point 18 and tapered end 14 fits around the hand and attaches to the glove fastener 30 without interfering with the interlocking and overlapping engagement between the hands on the golf club. The tapered end 14 has a smaller width than the anchor end 16 so that the strap 12 gradually tapers into the tapered end 14 and does not bunch up when the golfer is gripping and swinging the club. Thus, it has been determined that the instant invention 10 works more efficiently when the strap 12 has an anchoring end 16 that attaches over the three outside knuckles, a first uniform portion that stretches over the three outside fingers 41–43 and a second tapered portion that gradually stretches from the mid-portion 18 to the tapered end 14 so that it comfortably fits and securely attaches to the glove just behind the thumb knuckle. In the preferred embodiment, the tapered end 14 is approximately 1¾ inches and the anchored end 16 is approximately three inches. The dimensions provided herein have been determined to work best universally, but may vary without departing from the scope and spirit of the instant invention. Additional comfort is provided to the wearer by stitching a leather or vinyl material to the strap outer surface of the strap 12 to provide an outside finished surface 19, opposite the fastening surface 17.

The elastic strap 12 is removably and securely attached to the glove 40 with strap fasteners 20, 21 and glove fasteners 30, 31. The strap fasteners include a first strap fastener 20 permanently attached to the tapered end 14 and a second strap fastener 21 permanently attached to the anchor end 16. The strap fastener 20, 21 preferably comprise hook-and-loop strips (known in the art as VELCRO®) which are stitched 22 to the fastening surface 17 of the strap 12. In the preferred embodiment, the strap fasteners 20, 21 comprise the hook/rough fastening component of hook-and-loop. It has been determined that the first strap fasteners should be approximately one inch in width and at least as long as the width of the tapered end 14 and that the second strap fastener 21 should be approximately ¾ inch in width and at least as long as the width of the anchor end 16. It should be noted that these dimensions may vary without departing from the scope and spirit of the instant invention.

Figure 6:
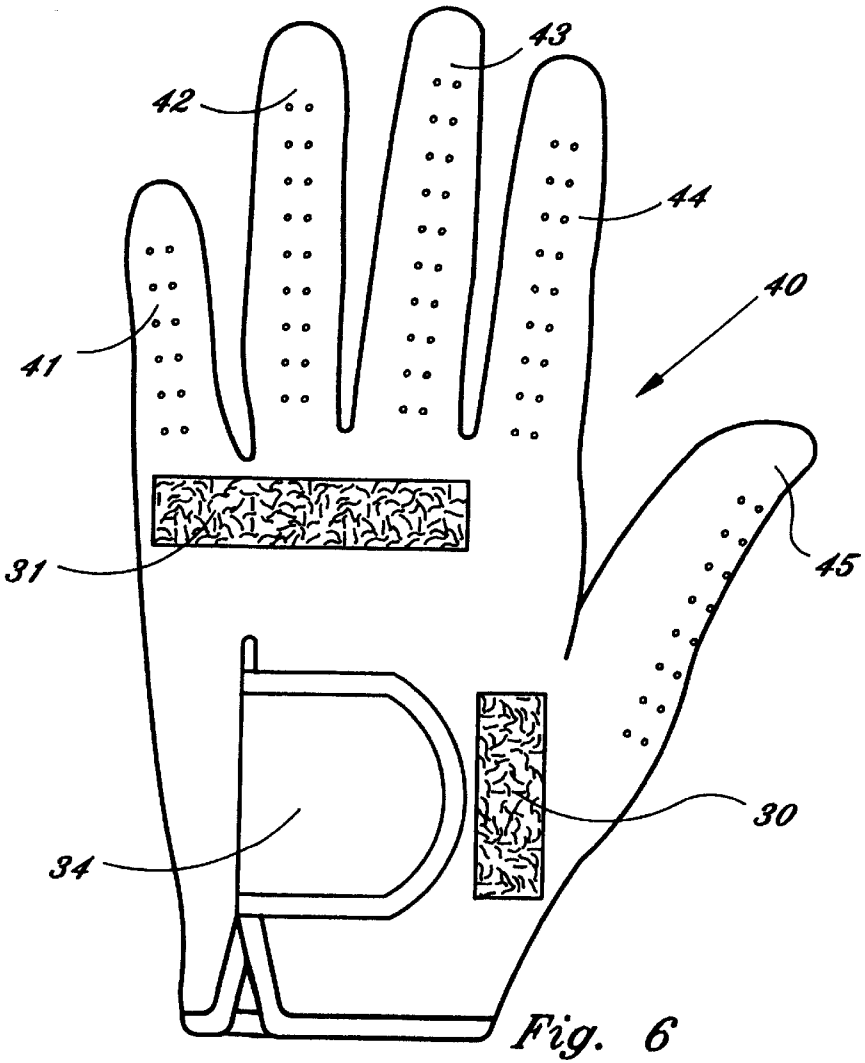
FIG. 6 is an elevational top view of a golf glove with the glove fasteners affixed thereto.

With reference to FIG. 6, the glove fasteners comprise a first glove fastener 30 and second glove fastener 31, both of which are attachable to the outside surface of the glove 40. The glove fasteners 30, 31 preferably comprise the loop/soft component of hook-and-loop to coincide and cooperate with the strap fasteners 20, 21. The loop fasteners also provide the most comfort and least obstruction to the golfer. The first glove fastener 30 is preferably attached to the glove just above the thumb knuckle and next to the golfer's wrist fastener 34 for releasably attaching and cooperating with the first strap fastener 20. The second glove fastener 31 is preferably attached to the glove just above the outside three knuckles for releasably attaching and cooperating with the second strap fastener 21. The glove fasteners 30, 31 are preferably attached permanently to the glove 40 with an adhesive 32 when the instant invention is manufactured and packaged as a kit for use with existing gloves. A preferred adhesive comprises contact cement which is applied to the glove and the glove fasteners 30, 31 and is allowed to partially dry and set prior to attaching the fasteners 30, 31 to the coated area of the glove 40. Other adhesives in the art, such as Super Glue® and other quick setting glues, may be employed. A quick setting glue is preferred with the instant invention. The glove to which the glove fasteners 30, 31 are attached may comprise any leather, vinyl, cloth or similar synthetic glove.

To prepare the instant invention for use, the glove fasteners 30, 31 are placed on the glove just above the thumb knuckle next to the wrist fastener 34 and over the three outside knuckles, respectfully. The glove 40 is then marked in the areas where the fasteners 30, 31 will be attached so that adhesive 32 may be applied to the marked area. If a contact cement is used, it is first applied to one side of both glove fasteners 30, 31 and to the glove within the marked areas. After the contact is allowed to set for a predetermined period of time, the glove fasteners 30, 31 are applied and pressed firmly to the glove 40. It should be noted that other quick setting glues may be used, such as Super Glue®. In an alternative environment, the glove fasteners 30, 31 may be stitched to the glove 40. In this embodiment, the strap fasteners 20, 21 should be permanently stitched to the strap 12 as previously discussed. Once the glove fasteners 30, 31 are securely fixed to the glove, the invention is ready for use.

To use the instant invention, the user first puts the glove on its hand. The second strap fastener 21 and anchor end 16 is then aligned with and attached to the second glove fastener 31 so that a true hook-and-loop mating connection is made. After the anchoring end 16 is attached to the glove 40, the user grips a golf club in preparation for the shot. Using the opposite hand, the tapered end 14 of the elastic strip 12 is pulled over the three outside fingers 41–43, around the base of the thumb 45, and attached to the first glove fastener 30 so that the first strap fastener 20 makes a hook-and-loop connection. Once the tapered end 14 is securely affixed to the glove fastener 30, the golfer is ready to take a shot. Given the elastic bands width, shape, thickness and the way it attaches to the glove, the invention 10 does not interfere with the interlocking grip between the hands. To change clubs, the user merely removes the tapered end 14, selects another club, and secures the strap 12 as described above. If the elastic strap 12 is not needed, it can be completely removed by detaching the anchor end 16 and placing it in the user's pocket or golf bag.

In an alternate embodiment, the glove fastener 30, 31 may be permanently affixed to the glove with stitching. In this embodiment, the glove fastener 30, 31 and glove 40 of the instant invention are manufactured and packaged together. Thus, the glove fasteners 30, 31 would already be attached to the glove 40 before use.

Figure 9:
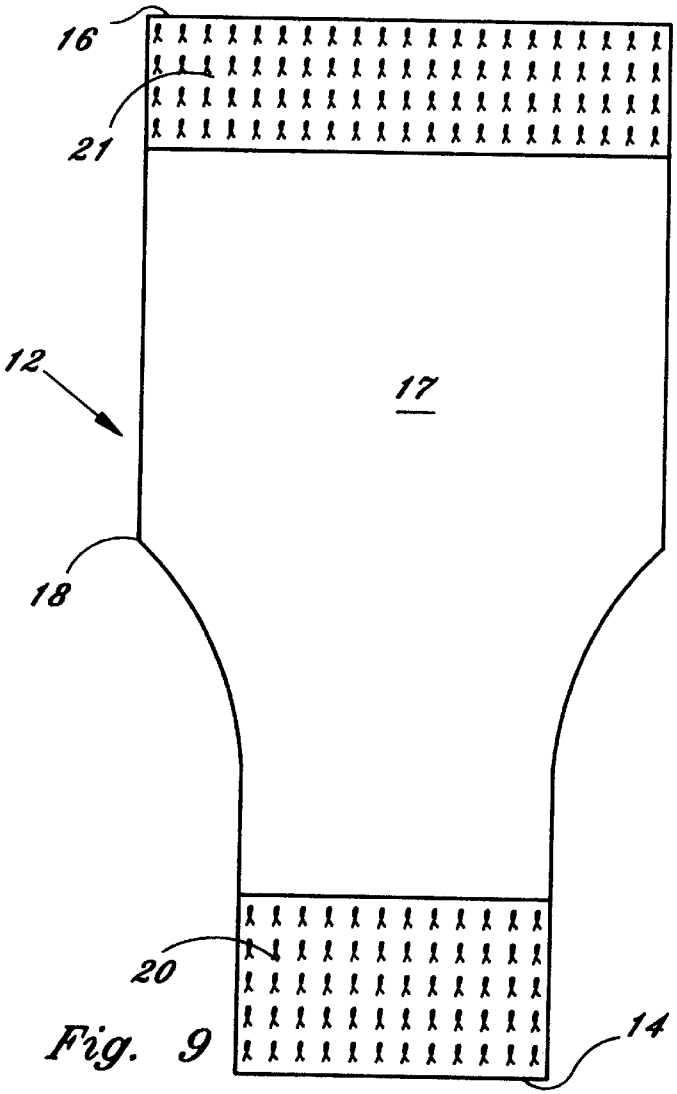
FIG. 9 is an elevational view of an alternate embodiment of the elastic strap of the instant invention.

In another embodiment, the fasteners 20, 21 and glove fasteners 30, 31 may alternate between the hook strips and loop strips so that the elastic strap 12 can only be oriented in one position on the glove. The glove and strap fasteners 20, 21 and 30, 31 may comprise other types of connectors known in the art, such as snaps. In another embodiment of the instant invention, the strap 12 may comprise a curved transition between mid-point 18 and the tapered end 14, as shown in FIG. 9. In this embodiment, the elastic band curves from its top end and its bottom end as it gradually joins with the tapered end 14. As in the preferred embodiment, the strap fasteners 20, 21 are stitched to the tapered end 14 and anchor end 16, respectively.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A novel golf glove apparatus for enhancing a golfer's grip on a golf club when swinging, said apparatus comprising:

a golf glove having a top surface which covers the top of a golfer's hand, a bottom surface which covers the palm of a golfer's hand, a plurality of finger pockets and a thumb pocket for receiving a golfer's hand, fingers, and thumb;

a stretchable strap having a tapered end and an anchored end, said strap being removably attachable to the top surface of said glove;

a glove fastener means for releasably securing said strap to the top surface of said glove, said glove fastener means comprising a first hook-and-loop strip attached to the top surface of said glove by said attaching means in alignment with said selected finger pockets and positioned to be over the golfer's three outside finger knuckles when the glove is worn, and a second hook-and-loop strip attached to the top surface of said glove by said attaching means in alignment with said thumb pocket and positioned on the glove to be over the golfer's thumb knuckle when worn;

a strap fastener means, securely attached to said strap, for removably attaching said anchoring end to said glove fastener above said selected finger pockets and said tapered end to said glove fastener above said knuckle pocket, said anchoring end securing said strap as said tapered end stretches over said selected finger pockets and attaches to said glove fastener means to secure a golfer's fingers around the golf club, said strap fastener means cooperating with said glove fastener means to make a releasable mating connection; and means for securely attaching said glove fastener means to said glove exterior surface.

2. An apparatus as recited in claim 1, wherein said strap fastener comprises:

a first corresponding hook-and-loop strip attached to said anchoring end for facilitating a hook-and-loop attachment with said first hook-and-loop strip; and a second corresponding hook-and-loop strip attached to said tapered end for facilitating a hook-and-loop attachment with said second hook-and-loop strip.

3. An apparatus as recited in claim 2, wherein said first and second hook-and-loop strips comprise loop fasteners and wherein said corresponding first and second hook-and-loop strips comprise hook fasteners for releasably attaching to said loop fasteners.

4. An apparatus as recited in claim 3, wherein said tapered end has a smaller width than said anchoring end for fitting around the thumb pocket without bunching up during use.

5. An apparatus as recited in claim 4, further comprising an exterior liner securely attached to said strap on a surface opposite said anchoring end and said tapered end for corresponding with said glove exterior surface.

* * * * *